US007418957B2

(12) United States Patent
Abe

(10) Patent No.: US 7,418,957 B2
(45) Date of Patent: Sep. 2, 2008

(54) VEHICLE CONTROL METHOD AND VEHICLE CONTROL APPARATUS

(75) Inventor: Hiroshi Abe, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/714,005

(22) Filed: Mar. 5, 2007

(65) Prior Publication Data

US 2007/0204840 A1 Sep. 6, 2007

(30) Foreign Application Priority Data

Mar. 6, 2006 (JP) ..... 2006-059274

(51) Int. Cl.
*F02D 41/14* (2006.01)

(52) U.S. Cl. ..... 123/697; 204/425; 219/497

(58) Field of Classification Search ..... 123/688, 123/690, 697; 204/406, 425; 219/205, 497
See application file for complete search history.

(56) References Cited

U.S. PATENT DOCUMENTS

| | | | | |
|---|---|---|---|---|
| 4,753,204 | A * | 6/1988 | Kojima et al. | 123/697 |
| 4,765,298 | A * | 8/1988 | Kojima et al. | 123/697 |
| 6,476,364 | B1 * | 11/2002 | Shimamura et al. | 123/697 |
| 7,084,379 | B2 * | 8/2006 | Saito et al. | 123/697 |
| 2003/0213795 | A1 * | 11/2003 | Toyoda | 219/501 |
| 2005/0205550 | A1 * | 9/2005 | Saito et al. | 219/497 |
| 2007/0271904 | A1 * | 11/2007 | Shouda et al. | 60/284 |

* cited by examiner

*Primary Examiner*—T. M. Argenbright
(74) *Attorney, Agent, or Firm*—Global IP Counselors, LLP

(57) ABSTRACT

A vehicle control apparatus and methodology relate to an exhaust gas sensor and sensor heater associated with an exhaust passage of a vehicle engine. The exhaust gas sensor is selectively heated to an applicable activation temperature by the heater so that the sensor may output a normal and accurate sensing signal. The heating must take place, however, without causing damage to the sensor such as that resulting from condensation that may occur within the exhaust passage as a result of engine operation and environmental conditions.

19 Claims, 9 Drawing Sheets

| OUTSIDE-AIR TEMPERATURE [°C] | SATURATED WATER VAPOR PRESSURE P0 | |
|---|---|---|
| | [mmHg] | [kPa] |
| 0 | 4.58 | 0.61 |
| 10 | 9.21 | 1.23 |
| 20 | 17.5 | 2.33 |
| 30 | 31.8 | 4.24 |
| 40 | 55.3 | 7.37 |
| 50 | 92.5 | 12.3 |
| 60 | 149 | 19.9 |
| 70 | 234 | 31.2 |
| 80 | 355 | 47.3 |
| 90 | 526 | 70.1 |
| 100 | 760 | 101.3 |

UNDER ATMOSPHERE PRESSURE = 760mmHg

| OUTSIDE-AIR TEMPERATURE [°C] | EXHAUST GAS WATER VAPOR PRESSURE P3 [mmHg] | [kPa] |
|---|---|---|
| 0 | 99.8 | 13.30 |
| 10 | 103.5 | 13.80 |
| 20 | 110.2 | 14.69 |
| 30 | 121.8 | 16.24 |
| 40 | 140.9 | 18.78 |
| 50 | 171.0 | 22.79 |
| 60 | 216.8 | 28.90 |
| 70 | 285.7 | 38.08 |
| 80 | 383.8 | 51.16 |
| 90 | 522.3 | 69.62 |
| 100 | 712.0 | 94.91 |

VEHICLE CONTROL METHOD AND VEHICLE CONTROL APPARATUS

CROSS-REFERENCES TO RELATED APPLICATION

This application claims priority from Japanese Patent Application Serial 2006-059274 filed Mar. 6, 2006, the entire contents of which are incorporated herein by reference.

TECHNICAL FIELD

The disclosed methods and apparatuses relate to controlling vehicles, and more particularly to a heating control for heating an exhaust gas sensor to an activation temperature.

BACKGROUND

In some engines, exhaust gas sensors, such as an air-fuel ratio sensor for sensing the air-fuel ratio of exhaust gas and an $O_2$ sensor for sensing the oxygen concentration, are attached to exhaust passages such as exhaust pipes. In order for such an exhaust gas sensor to output a normal and accurate sensing signal, it is generally necessary to raise the temperature of the exhaust gas sensor to an activation temperature. In such a case, an exhaust gas sensor is heated by a separate heating device such as a heater, because it takes a long time to solely heat an exhaust gas sensor by the heat contained in exhaust gas and passing through the exhaust passages.

On the other hand, in such an engine as an exhaust gas sensor is heated by a distinct heating device such as a heater, when condensation (where water vapor within an exhaust pipe is cooled down by outside air, and condensed into water) occurs at the exhaust gas sensor positioned in an exhaust passage while the exhaust gas sensor is being heated, it is possible that a heat shock may be caused in the exhaust gas sensor resulting in undesirable failure such as through cracking of a critical element of the sensor.

Accordingly, in Japanese Patent No. 3636047 an exhaust pipe temperature is estimated. When the estimated exhaust pipe temperature is higher than or equal to a predetermined value, it is judged that the temperature in an exhaust pipe is not at a temperature at which condensation occurs, and electric power supply to a heater is started. Conversely, stopping the supply of electric power to the heater associated with an exhaust gas sensor when the temperature in the exhaust passage is at a temperature at which condensation occurs, minimizes the chance of sensor failure (e.g., cracking of a sensor element), increasing the durability of the exhaust gas sensor.

According the Japanese Patent No. 3636047 the threshold temperature below which condensation occurs within the exhaust pipe is set by experiment to a substantially constant value (about 52° C. to 54° C.).

SUMMARY

In the above-described engine, which is provided with an exhaust gas sensor and a separate heating device, the threshold temperature below which condensation occurs within an exhaust passage such as an exhaust pipe depends significantly on environmental conditions such as the temperature and humidity of outside air and the atmospheric pressure, and on engine specifications.

However, where the condensation occurrence temperature is set to a substantially constant value, such as the case according to the technique of Japanese Patent No. 3636047, it is possible that even while condensation occurs within an exhaust passage, an exhaust gas sensor is heated to its activation temperature by a heating device. Further, it is possible that even while condensation does not occur within the exhaust pipe, the heating performed by the heating device is stopped.

The problem is aggravated in a so-called hybrid vehicle which, has the functions of automatically stopping an engine when a predetermined operating condition is satisfied, and automatically restarting the engine when another predetermined operating condition is satisfied, and which drives the vehicle with at least one of a motor and the engine. In such a hybrid vehicle, which is provided with the exhaust gas sensor and the heating device, it is impossible to judge precisely whether or not condensation occurs within an exhaust passage by setting the condensation occurrence temperature to a substantially constant value. This causes a situation where even while condensation occurs within the exhaust pipe, an exhaust gas sensor is heated to its activation temperature by a heating device, and a situation where even while condensation does not occur within the exhaust pipe, the heating performed by the heating device is stopped. As a result, the durability of the exhaust gas sensor decreases significantly, and the quantity of deleterious components within engine generated exhaust increases due to a delay in the start of feedback control of an air-fuel ratio within the engine.

Accordingly, it is desirable to ensure compatibility between activation of an exhaust gas sensor and prevention of heat shock to the exhaust gas sensor by precisely controlling operation of a separate heating device associated with the sensor such as that employed in a vehicle which includes the functions of automatically stopping an engine when a predetermined operating condition is satisfied, and automatically restarting the engine when another predetermined operating condition is satisfied (e.g., a hybrid vehicle).

According to exemplary teachings, a vehicle control apparatus for a vehicle, includes an engine with an exhaust gas sensor attached to an exhaust passage of the engine for sensing a property of exhaust gas, and a heating device for heating the exhaust gas sensor. In the case of a hybrid vehicle when a predetermined operating condition is satisfied, the engine automatically stops. When another predetermined operating condition is satisfied the engine automatically restarts. The vehicle control apparatus includes an environmental condition sensing mechanism for sensing when the engine is automatically stopped. The vehicle control apparatus further includes a controller, wherein the controller includes a condensation occurrence temperature estimation mechanism for estimating a condensation occurrence temperature based on a specification of the engine and based on the environmental condition. Moreover, the vehicle control apparatus includes a heating controller associated with a heating device capable of heating an associated exhaust gas sensor to its activation temperature by the heating device if a temperature of the exhaust passage is higher than or equal to the condensation occurrence temperature when the engine is automatically stopped, and performing, if the exhaust passage temperature is lower than the condensation occurrence temperature when the engine is automatically stopped, one of lowering heating performance of the heating device and stopping the heating performed by the heating device.

According to the disclosure herein, it is possible to ensure compatibility between activation of an exhaust gas sensor and prevention of heat shock of the exhaust gas sensor by precisely controlling operation of a heating device associated with the sensor, particularly in a hybrid type vehicle, which includes the functions of automatically stopping an engine when a predetermined operating condition is satisfied, and automatically restarting the engine when another predetermined operating condition is satisfied.

BRIEF DESCRIPTION OF DRAWINGS

While the claims are not limited to the illustrated embodiments, an appreciation of various aspects of the system is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows.

DETAILED DESCRIPTION

Hereinafter, exemplary embodiments are described with reference to the accompanying drawings.

Figure 1:
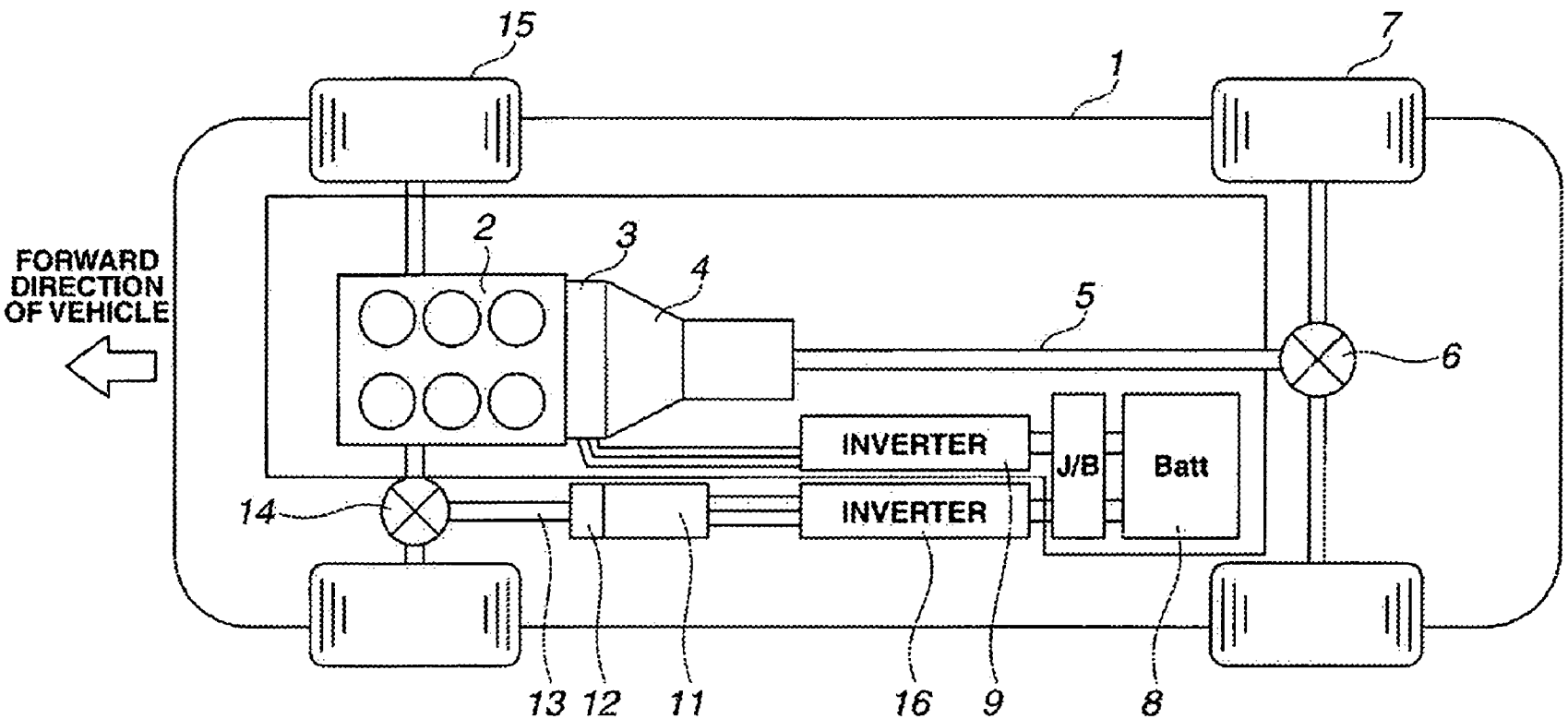
FIG. 1 is a schematic construction diagram of a vehicle control apparatus according to a first embodiment.
Figure 2A:
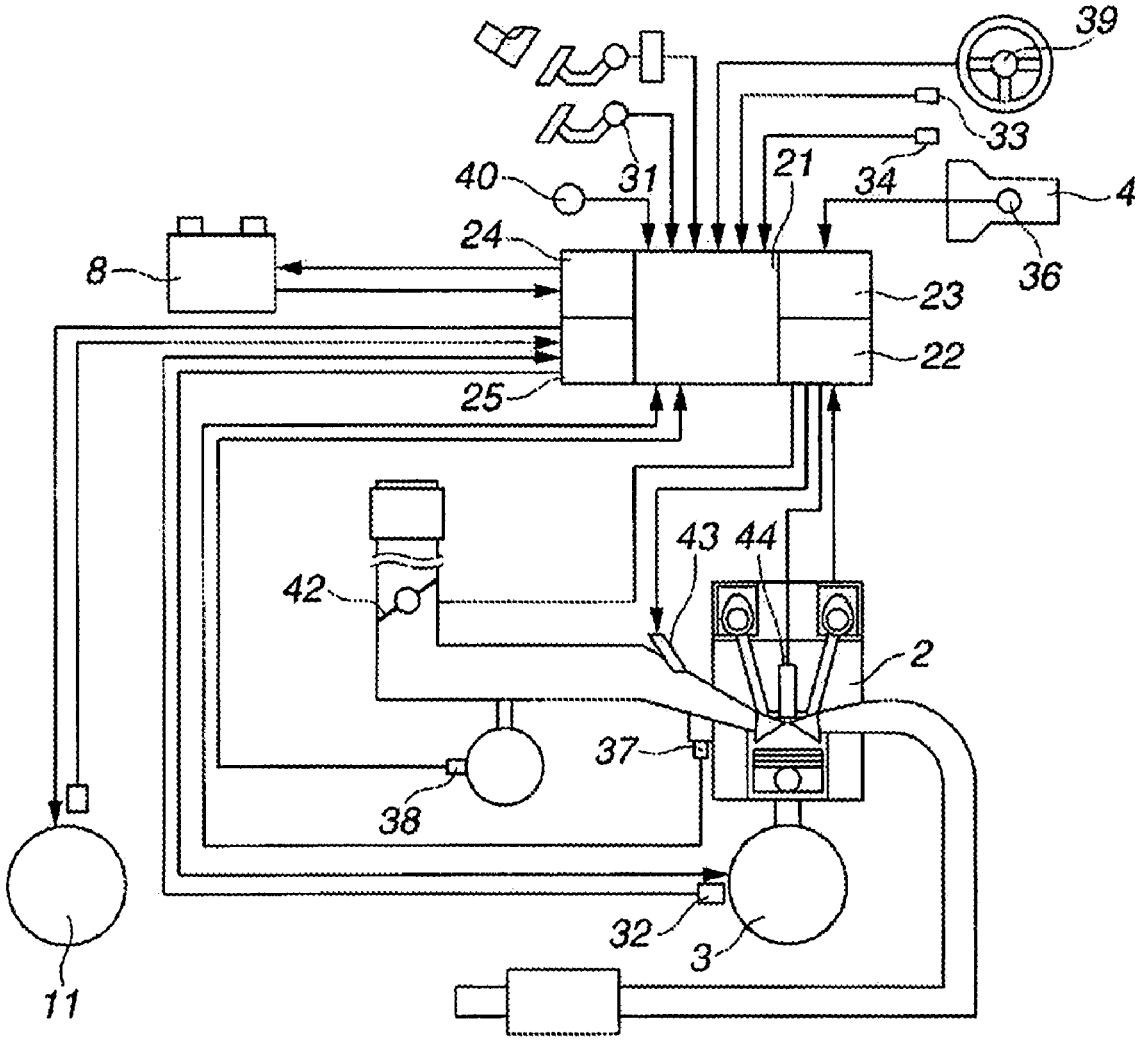
FIG. 2A is a schematic construction diagram of a vehicle control system according to the first embodiment.

FIG. 1 shows schematic construction of a control apparatus according to an embodiment. FIG. 2A shows a schematic construction of a control system of a vehicle.

The shown vehicle is a so-called hybrid vehicle, which is driven by at least one of a motor and an engine. In this embodiment, an engine provided with at least one exhaust gas sensor and a heating device for the exhaust gas sensor is applied to a so-called hybrid vehicle having functions of automatically stopping an engine when a predetermined operating condition is satisfied and automatically restarting the engine when another predetermined operating condition is satisfied.

As shown in FIGS. 1 and 2A, a motor generator 3 is disposed between an engine 2 and a continuously variable transmission 4. Rotation of engine 2 or motor generator 3 is transmitted to drive wheels (rear wheels) 7 through the continuously variable transmission 4, a drive shaft 5, one end of which is connected to the transmission, and a differential gear 6 connected between the wheels and drive shaft.

For example, continuously variable transmission 4 comprises a torque converter, a forward-reverse switch mechanism and a metal belt looped between variable pulleys. The speed ratio through the metal belt is altered by altering the pulley ratio between the variable pulleys. A desired speed ratio for the continuously variable transmission 4 is set in accordance with the operating state. A primary oil pressure and a secondary oil pressure for actuating the variable pulleys are controlled such that the desired speed ratio agrees with the speed ratio, which represents the ratio between actual input and output rotational speeds.

The forward-reverse switch mechanism switches the direction of output rotation between forward drive and reverse drive. The torque converter transmits a torque of input rotation to an output section through the action of fluid, and may stop rotation of the output section when, for example, an input section rotates extremely slowly.

Motor generator 3 is connected directly or through a belt or a chain to a crankshaft of engine 2 to rotate in synchronization with engine 2. Motor generator 3 functions as an electric motor or as an electric generator. When motor generator 3 functions as an electric motor to assist the output of engine 2, or to start the engine 2, electric current is supplied from a battery (42V battery) 8 through an inverter 9. When motor generator 3 functions as an electric generator to recycle a running energy of the vehicle, battery 8 is charged by the electric current generated through inverter 9.

On the other hand, another motor generator 11 is provided. Rotation of motor generator 11 is transmitted to drive wheels (front wheels) 15 through a speed reduction gear 12, a drive shaft 13 and a differential gear 14. Motor generator 11 also functions as an electric motor or as an electric generator. In a similar manner to motor generator 3, when motor generator 11 functions as an electric motor, electric current is supplied from battery 8 through an inverter 16. When motor generator 11 functions as an electric generator to recycle the running energy of the vehicle, battery 8 is charged by the electric current generated through inverter 16. While a single battery 8 is illustrated there may be a plurality of batteries. Further, while two motor generators are illustrated, there could be fewer or more of such generators.

Hereinafter, motor generators 3 and 11 are each referred to simply as a "motor".

As shown in FIG. 2A, signals are inputted from an accelerator sensor 31 and a vehicle speed sensor 40 to a controller 21. For a hybrid vehicle, controller 21 may be called a hybrid controller. On the basis of inputs from sensors 31 and 40, hybrid controller 21 may control various aspects of vehicle operation including control of acceleration, constant speed or deceleration, in cooperation with an engine controller 22, a transmission controller 23, a battery controller 24 and a motor controller 25. Incidentally, vehicle speed sensor 40 may compute the vehicle speed, on the basis of an engine rotational speed detected by an engine rotational speed sensor 32, the speed ratio of continuously variable transmission 4, etc.

Four wheel drive ("4WD") is possible by separately transmitting driving efforts to front wheels 15 and rear wheels 7. Accordingly, when a 4WD switch 33 provided in a passenger compartment of a vehicle is turned to an "ON" state, hybrid controller 21 implements a vehicle start from a state of creep running by 4WD drive.

Further, an assist switch 34 is provided in order to produce a predetermined acceleration when necessary. When assist switch 34 is turned to an "ON" state by a driver, hybrid controller 21 allows the motor 11 to assist the driving effort.

On the other hand, in order to stop automatically engine 2 (idle stop) when a predetermined operating condition (idle stop permission condition) is satisfied while the vehicle is running, and to automatically restart engine 2 when another predetermined operating condition is satisfied (when the idle stop permission condition is unsatisfied) after that, hybrid controller 21 is configured to stop the operation of engine 2 when a predetermined operating condition is satisfied while the vehicle is running, and to restart the engine 2 by motor 3 when another predetermined operating condition is satisfied after that. Incidentally, the idle stop permission condition does not include a condition that the vehicle speed=0 km/h and a brake is operating. That is, the system is configured such that the engine is automatically stopped even while the vehicle is running, and restarted after the engine automatic stop also while the vehicle is running.

Accordingly, signals are inputted into hybrid controller 21 from a shift position sensor 36 for continuously variable transmission 4, an intake pressure sensor 38, a steering angle sensor 39, etc., in addition to accelerator sensor 31 and engine rotational speed sensor 32. On the basis of those, hybrid controller 21 controls the automatic stop and restart of engine 2 through engine controller 22. While two separate controllers 21 and 22 are illustrated, they may actually be combined together in some instances into a single controller.

While engine 2 is operating, engine controller 22 controls the opening of a throttle valve 42 in accordance with accelerator opening and engine rotational speed, controls the quantity of fuel injected by a fuel injection valve 43 and the timing of fuel injection, and further controls an ignition timing when ignition plug 44 makes ignition sparks fly, so as to produce an engine output to provide a requested driving effort. When receiving a command of engine automatic stop from hybrid controller 21, engine controller 22 turns back the engine into an idle state, and then cuts off the supply of fuel from fuel injection valve 43 and also stops the operation of ignition plug 44. When receiving a command of engine restart from hybrid controller 21 after that, engine controller 22 restarts the supply of fuel from fuel injection valve 43 and restarts the operation of ignition plug 44.

Figure 2B:
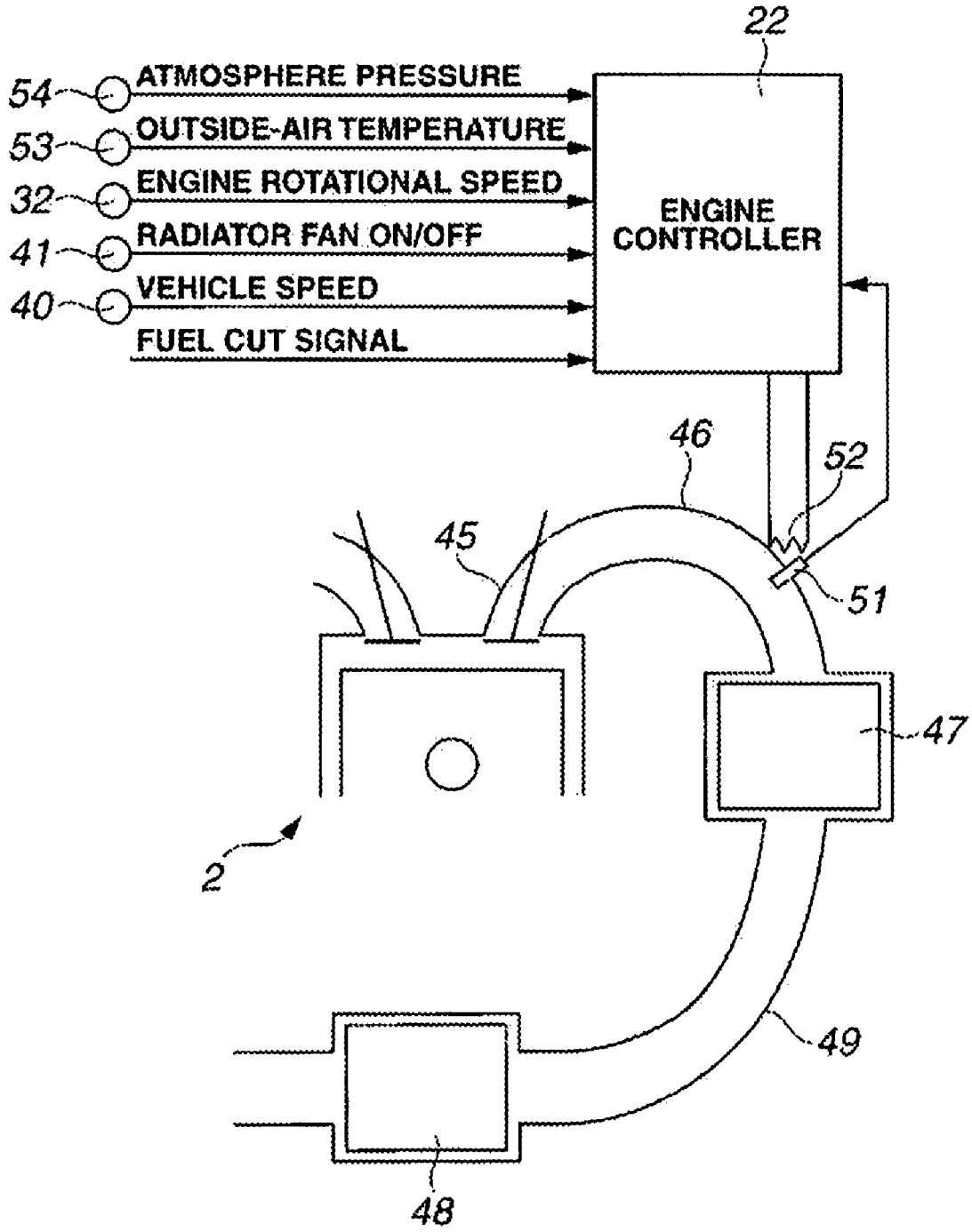
FIG. 2B is a schematic construction diagram of a control system of an exhaust purifier.

FIG. 2B shows a schematic construction of a control system of an exhaust purifier of engine 2.

An exhaust port 45 of engine 2 is connected to an exhaust manifold 46. A first catalyst (manifold catalyst) 47 is connected to a position downstream from exhaust manifold 46. Further, a second catalyst (underfloor catalyst) 48 is connected to a position downstream from first catalyst 47 through an exhaust passage 49. For example, two catalysts 47 and 48 are three-way catalysts. However, each of two catalysts 47 and 48 is not limited to a three-way catalyst, and may be any catalyst other than three-way catalyst, such as a NOx occlusion catalyst, according to requested exhaust performance.

An air-fuel ratio sensor (exhaust gas sensor) 51 is installed immediately upstream of first catalyst 47. The output of air-fuel ratio sensor 51 is outputted to engine controller 22. While sensor 51 is an air-fuel ratio sensor in the illustrated approach, the discussion below applies to any form of exhaust gas sensor, including, for example, an oxygen ("$O_2$")_sensor Here, in order for air-fuel ratio sensor 51 to output a normal and accurate sensing signal, it is necessary to raise the temperature of air-fuel ratio sensor 51 to at least its activation temperature. Although it is possible to raise the temperature of air-fuel ratio sensor 51 to its activation temperature by using exhaust heat from engine 2 as generated through normal engine operation, such an approach is inefficient and typically time consuming. Thus, a separate heater (heating device) 52 is installed close to air-fuel ratio sensor 51 in order to shorten the period taken to reach the activation temperature. In the exemplary embodiment heater 52 is a device that generates a heat through resistance energization heating, but may be any other heater, such as a heater that carries out heating by burning fuel.

When in such an engine provided with air-fuel ratio sensor 51 and heater 52, condensation (where the water vapor within exhaust manifold 46 is cooled down by outside air, adhered to the inside wall of exhaust manifold 46, and condensed into water) may occur at air-fuel ratio sensor 51 in exhaust manifold 46 while air-fuel ratio sensor 51 is being heated. When condensation while sensor 51 is being heated such as through the use of heater 52, it is possible that the sensor 51 may be inadvertently damaged such as through subjection to a heat shock, which in turn may crack a sensor element. Accordingly, it is necessary to prevent condensation from occurring at air-fuel ratio sensor 51 under heating.

Accordingly, engine controller 22 receives a variety of inputs including a subset of the following: an outside-air temperature sensed by a temperature sensor 53; the atmospheric pressure sensed by a pressure sensor 54; the engine rotational speed sensed by engine rotational speed sensor 32 as a parameter relevant to the gas exhausted to the exhaust pipe until the engine stops after the fuel supply is stopped; the operating state of a radiator fan sensed by a radiator fan operating signal sensing mechanism 41; the vehicle speed sensed by vehicle speed sensor 40; a signal relevant to fuel cut, etc. On the basis of the various inputs, engine controller 22 estimates the temperature of exhaust manifold 46 (exhaust pipe temperature), Texmani; estimates a condensation occurrence temperature Tktr based on an environmental condition (including at least one of the outside-air temperature, the outside-air humidity and the atmospheric pressure); heats air-fuel ratio sensor 51 to its activation temperature by heater 52 when exhaust manifold temperature Texmani is higher than or equal to condensation occurrence temperature Tktr; and lowers heating performance of heater 52 or stops heating performed by heater 52 when exhaust manifold temperature Texmani is lower than condensation occurrence temperature Tktr during idle stop.

In the illustrated embodiment, attention is focused on that condensation, which occurs when the exhaust gas exhausted from cylinder to exhaust manifold 46 is cooled at an interface surface of exhaust manifold 46 by outside air such that the partial pressure of the water vapor contained in the exhaust gas exceeds the saturated water vapor pressure. On the basis of the exhaust gas quantity, exhaust gas temperature, specific heat, heat transfer rate, etc. of the gas exhausted to the exhaust pipe during idle stop until the engine stops after the fuel supply is stopped in the engine, an in-exhaust-manifold water vapor partial pressure is further calculated by an exhaust gas water vapor partial pressure calculating mechanism On the basis of the in-exhaust-manifold water vapor partial pressure during idle stop, condensation occurrence temperature Tktr is estimated.

In the following, concepts regarding the in-exhaust-manifold water vapor partial pressure during idle stop are described with reference to FIG. 3, and then a method for estimating condensation occurrence temperature Tktr is described.

Figure 3:
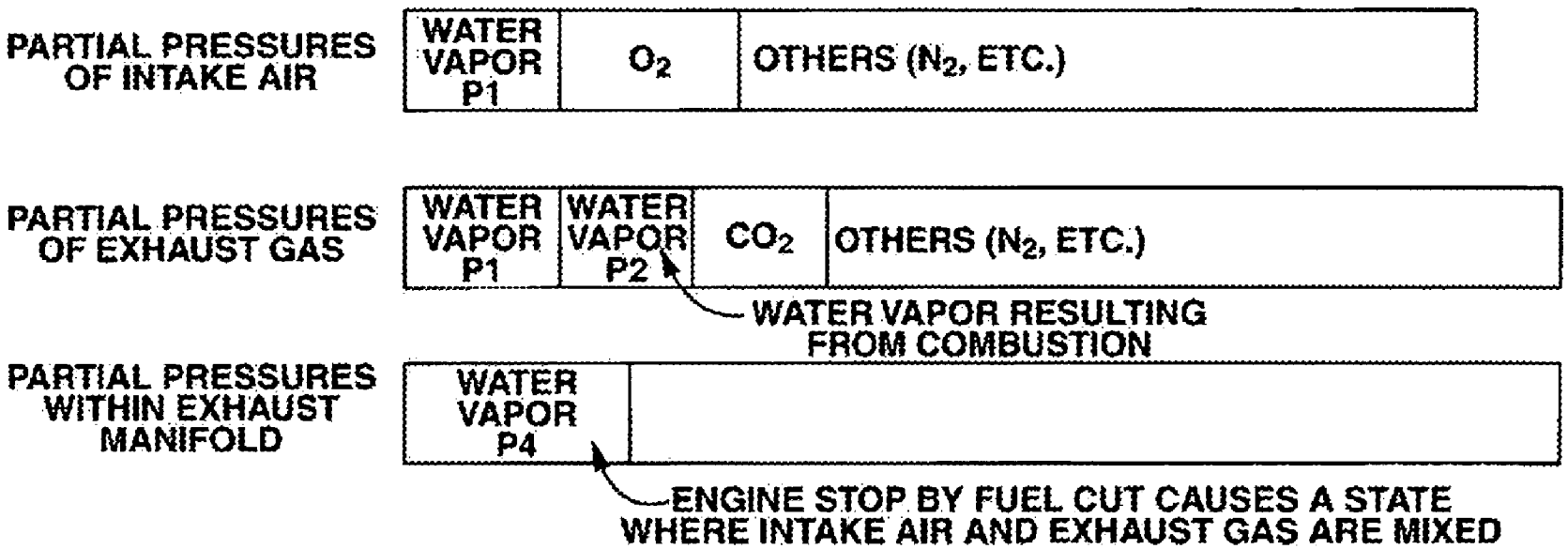
FIG. 3 is a diagram showing models of the water vapor partial pressure of intake air, the water vapor partial pressure of exhaust gas, and the water vapor partial pressure within an exhaust manifold during idle stop.

FIG. 3 shows, from top to bottom, models of the water vapor partial pressure of intake air, the water vapor partial pressure of exhaust gas, and the water vapor partial pressure within exhaust manifold 46 during idle stop. As shown in FIG. 3, the water vapor partial pressure of exhaust gas contains a water vapor partial pressure of intake air, P1, and further a water vapor partial pressure P2 resulting from combustion. At idle stop, engine controller 22 cuts off the supply of fuel from fuel injection valve 43 to stop the engine, so that the engine stops after the engine has rotated some turns from the timing when the fuel supply is cut off. As a result, after the fuel supply is cut off, intake air (fresh air) flows into cylinders by coasting rotation of the engine and directly flows out to exhaust manifold 46. Accordingly, when the engine is in a stop state, the water vapor partial pressure of exhaust gas, and the water vapor partial pressure of intake air exhausted after the fuel supply is cut off, are mixed in exhaust manifold 46.

The following specifically describes the water vapor partial pressure of intake air, P1, the water vapor partial pressure resulting from combustion, P2, the water vapor partial pressure of exhaust gas, P3, the water vapor partial pressure within exhaust manifold 46, P4, and condensation occurrence temperature Tktr, in the same order.

<1> The Water Vapor Partial Pressure of Intake Air, P1.

Condensation tends to occur within exhaust manifold 46 under the condition of high water vapor partial pressure. Accordingly, as an example, a case is assumed in which the humidity of intake air (the humidity of outside air) is equal to 100%. That is, saturated water vapor pressure P0 is used as intake air water vapor partial pressure P1 as follows.

$$P1=P0 \tag{1}$$

Figures 4A, 4B:
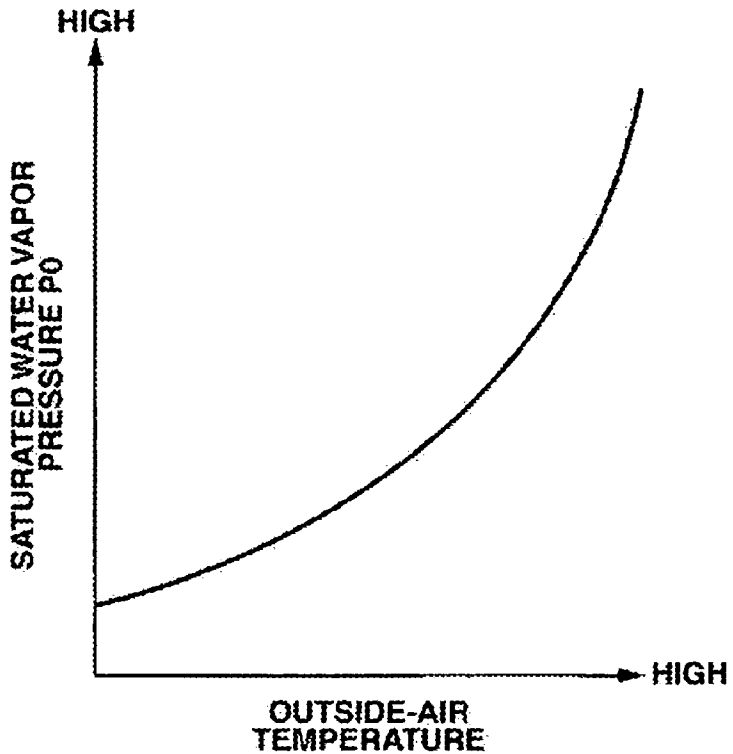
FIGS. 4A and 4B are a table and a characteristic diagram of saturated water vapor pressure, respectively.

Saturated water vapor pressure P0 is determined in accordance with the temperature of outside air as shown in FIGS. 4A and 4B. FIG. 4A shows a table of saturated water vapor pressure P0 with respect to outside-air temperature as a parameter. FIG. 4B shows a schematic characteristic of saturated water vapor pressure P0 with respect to outside-air temperature. As shown in FIG. 4B, saturated water vapor pressure P0 has a characteristic of decreasing with decreasing outside-air temperature.

<2> The Water Vapor Partial Pressure Resulting from Combustion, P2

It is assumed that before idle stop, engine controller 22 turns throttle valve 42 back into the idle position (the engine back into idle state), and carries out combustion with the theoretical air-fuel ratio during idle state, i.e. that all of $O_2$ in intake air is used for combustion. The water vapor partial pressure resulting from combustion with the theoretical air-fuel ratio is calculated from the following chemical formula for combustion (molecular formula for gasoline combustion).

$$CH_{1.9}+1.475O_2 \rightarrow CO_2+0.95H_2O \tag{2}$$

where $CH_{1.9}$ is the average molecular formula of gasoline.

According to formula (2), 1.475 mol oxygen $O_2$ is necessary to generate 0.95 mol water vapor. Since the air contains 20.95% oxygen $O_2$, the number of moles of air necessary to draw 1.475 mol oxygen $O_2$ is 7.041 mol as follows.

$$1.475/0.2095=7.041[\text{mol}]$$

Under the assumption that only oxygen $O_2$ contributes to combustion, the number of moles of inert gases is 5.566 mol as follows.

$$7.041-1.475=5.566[\text{mol}]$$

Hence, the water vapor partial pressure of combustion gas, P2, is determined as follows.

$$\begin{aligned}&(\text{proportion of water vapor partial pressure of combustion gas})=(\text{water vapor partial pressure of combustion gas [mol]})/(\text{exhaust gas [mol]})\\&=H_2O/((\text{inert gases})+CO_2+H_2O)\\&=0.95/(5.566+1+0.95)\\&=0.95/7.516\\&=0.1264\end{aligned}$$

Therefore, combustion gas water vapor partial pressure P2 can be determined based on the proportion of water vapor partial pressure of combustion gas, atmospheric pressure Pa, and saturated water vapor pressure P0, using the following equation.

$$\begin{aligned}P2&=(Pa-P0)\times(\text{proportion of water vapor partial pressure of combustion gas})\\&=(Pa-P0)\times 0.1264\end{aligned} \tag{3}$$

<3> The Water Vapor Partial Pressure of Exhaust Gas, P3

Exhaust gas water vapor partial pressure P3 is calculated from the following equation.

$$\begin{aligned}P3&=(\text{water vapor partial pressure of combustion gas})+(\text{saturated water vapor pressure of outside air})\times(\text{correction factor for increase in exhaust volume})\\&=P2+P1\times(\text{correction factor for increase in exhaust volume})\end{aligned} \tag{4}$$

Here, the water vapor partial pressure is on a unit volume basis. Accordingly, as the volume increases due to combustion, the water vapor partial pressure decreases in terms of saturated water vapor pressure. The correction factor for increase in exhaust volume in the above equation (4) is provided for this consideration, and has a value of less than 1.0 as follows.

$$\begin{aligned}&(\text{correction factor for increase in exhaust volume})=(\text{air [mol]})/(\text{exhaust gas [mol]})\\&=7.041/7.516\\&=0.8104\end{aligned}$$

Hence, equation (4) is reduced as follows.

$$P3=P2+P1\times 0.8104 \tag{5}$$

The above equations (1) and (3) are substituted into equation (5).

$$\begin{aligned}P3&=(Pa-P0)\times 0.1264+P0\times 0.8104\\&=Pa\times 0.1264+P0\times 0.8104\end{aligned} \tag{6}$$

According to equation (6), exhaust gas water vapor partial pressure P3 is determined in accordance with atmospheric pressure Pa and saturated water vapor pressure P0. On the other hand, saturated water vapor pressure P0 is determined in accordance with the temperature of outside air. Therefore, exhaust gas water vapor partial pressure P3 is determined in accordance with atmospheric pressure Pa and the outside-air temperature, i.e. environmental conditions.

According to equation (6), for example, when atmospheric pressure Pa is 760 mmHg (101.3 kPa), exhaust gas water vapor partial pressure P3 is given by the following equations.

$$P3=760\times 0.1264+P0\times 0.8104\ [\text{mmHg}] \tag{7A}$$

$$P3=101.3\times 0.1264+P0\times 0.8104\ [\text{kPa}] \tag{7B}$$

Figures 5A, 5B:
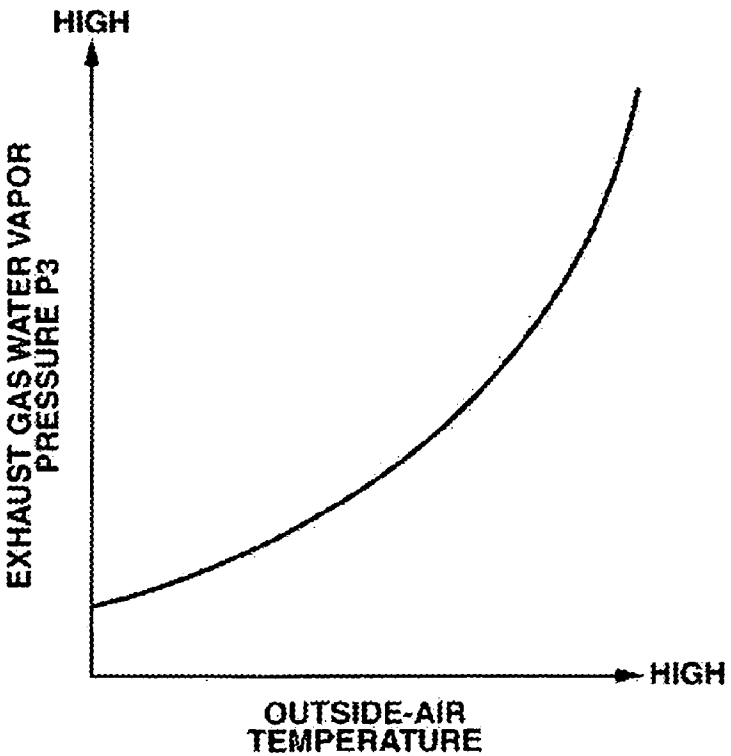
FIGS. 5A and 5B are a table and a characteristic diagram of the water vapor pressure of exhaust gas, respectively.

Since saturated water vapor pressure P0 is given as shown in FIG. 4A, exhaust gas water vapor partial pressure P3 is determined in accordance with outside-air temperature as shown in FIGS. 5A and 5B. FIG. 5A shows a table of exhaust gas water vapor pressure P3 with respect to outside-air temperature as a parameter, while FIG. 5B shows a schematic characteristic of exhaust gas water vapor pressure P3 with respect to outside-air temperature. As shown in FIG. 5B, the exhaust gas water vapor pressure has a characteristic of decreasing with decreasing outside-air temperature.

<4> The Water Vapor Partial Pressure in Exhaust Manifold, P4

In the situations where at idle stop, intake air (fresh air) flows into cylinders and directly flows out to exhaust manifold 46 until the engine stops after the fuel supply is cut off, it is considered that the exhaust gas and the fresh air exhausted into exhaust manifold 46 after the fuel supply is cut off, are mixed in exhaust manifold 46. In-exhaust-manifold water vapor partial pressure (the water vapor partial pressure of the gas resident within the exhaust pipe) P4 in this state is determined as follows.

Here, the engine is a straight four cylinder engine. Accordingly, detailed consideration is made assuming the following four conditions are preconditions.

Condition 1: Suppose the engine rotates substantially two turns until the engine stops after the fuel supply is cut off.

Incidentally, the rotation of two turns is for an engine used for an experiment. It is considered that the rotation of two turns does not hold for different engine specifications. Accordingly, the number of turns of rotation of an engine until the engine stops after the fuel supply is cut off is necessary to determine on the basis of the engine specification. In this embodiment, this is set on the assumption that the engine is a straight four cylinder engine. In general, the number of turns of rotation of an engine until the engine stops after the fuel supply is cut off intends to decrease with increasing displacement and increasing number of cylinders.

Condition 2: Set a valve timing control ("VTC") mechanism into a most retarded position before fuel supply is cut off. Suppose the intake valve closing timing ("IVC") at the most retarded position is after 93 degrees ("93°") from bottom dead center ("ABDC" 93 deg). In the case of an engine provided with no VTC mechanism, using a fixed intake valve closing timing is sufficient.

Condition 3: Suppose the intake pressure (intake pipe pressure at a position downstream from throttle valve 42) during the idle state immediately before idle stop, Boost, is substantially equal to 500 mmHg (66.65 kPa), because the engine is temporarily in idle state before idle stop.

Condition 4: Suppose the bore of each cylinder is 89 mm, and the piston stroke is 100 mm. Accordingly, the displacement per cylinder is 622 cc/cyl, giving a V0 of 0.622, which is used below.

When it is assumed that the above four conditions are preconditions, a cylinder intake capacity Vcyl is given by the following equation.

$$\begin{aligned} Vcyl &= V0 \times \{(1+\cos IVC[degABDC])/2\} \times (1-\text{Boost}/Pa) \\ &= 0.622[1] \times \{(1+\cos 93^\circ)/2\} \times \\ &\quad (1-500[\text{mmHg}]/760[\text{mmHg}]) \\ &= 0.101[1]\ (VTC \text{ at most retarded position}) \end{aligned} \tag{8}$$

Here, in equation (8), V0 is the volume of a particular cylinder and the term of V0×{(1+cos IVC[degABDC])/2} determines the volume at intake valve closing timing IVC. Further, in equation (8), the term of (1−Boost/Pa) indicates the partial pressure ratio of intake air with respect to the atmospheric pressure.

In a four cylinder engine, while the engine rotates substantially two turns until the engine stops after the fuel supply is cut off, the above cylinder intake air quantity flows into each of the four cylinders and flows out into exhaust manifold 46. The intake air quantity (fresh air quantity) exhausted into exhaust manifold 46 by the rotation (two turns) of the engine after the fuel supply is cut off, Vaex, is given by the following equation.

$$\begin{aligned} Vaex &= Vcyl \times (\text{the number of cylinders which performs} \\ &\quad \text{intake and exhaust after the fuel supply is cut off}) \\ &= 0.101[1/cyl] \times 4[cyl] \\ &= 0.404[1] \end{aligned} \tag{9}$$

If it is assumed that when the exhaust valve opens, exhaust gas flows from exhaust manifold 46 into the cylinder, that fresh air and exhaust gas are mixed in the cylinder and exhausted again into exhaust manifold 46, and that there is an equalized exhaust gas among the exhaust ports, the water vapor partial pressure within exhaust manifold 46 can be determined as follows. The volume of all the cylinders, Vtotal, is 0.622×4=2.488 liters. When it is assumed that this volume contains 0.404 liter fresh air and 2.084 (=2.488−0.404) liters exhaust gas, in-exhaust-manifold water vapor partial pressure P4 is given by the following equation.

$$\begin{aligned} P4 &= (\text{intake air water vapor partial pressure}) \times \\ &\quad (Vaex[1]/Vtotal[1]) + \\ &\quad (\text{exhaust gas water vapor partial pressure}) \times \\ &\quad ((Vtotal - Vaex)[1]/Vtotal[1]) \\ &= P1 \times (0.404/2.488) + P3 \times (2.084/2.488) \\ &= P1 \times 0.1624 + P3 \times 0.8376 \end{aligned} \tag{10}$$

The above equations (1) and (6) are substituted into equation (10).

$$\begin{aligned} P4 &= P0 \times 0.1624 + (Pa \times 0.1264 + P0 \times 0.8104) \times 0.8376 \\ &= P0 \times 0.8412 + Pa \times 0.1059 \end{aligned} \tag{11}$$

According to equation (11), in-exhaust-manifold water vapor partial pressure P4 is determined in accordance with saturated water vapor pressure P0 and atmospheric pressure Pa. On the other hand, saturated water vapor pressure P0 is determined in accordance with the outside-air temperature and atmospheric pressure Pa Therefore, in-exhaust-manifold water vapor partial pressure P4 is determined in accordance with the outside-air temperature and atmospheric pressure Pa, i.e. environmental conditions. Equation (11) is determined assuming the above four conditions. The values that appear in the four conditions (specifically, the number of turns of engine rotation until the engine stops after the fuel supply is cut off, the intake valve closing timing at idle state, the intake pressure at idle state, Boost, the cylinder bore diameter, and the piston stroke) are determined in accordance with engine specification. Therefore, in-exhaust-manifold water vapor partial pressure P4 also depends on engine specification. In summary, in-exhaust-manifold water vapor partial pressure P4 is determined in accordance with environmental conditions and engine specifications. This means that it is possible to calculate in-exhaust-manifold water vapor partial pressure P4 on the basis of environmental conditions and engine specifications.

<5> Condensation Occurrence Temperature Tktr

Temperature Tktr, at or below which condensation occurs within exhaust manifold 46, is a temperature at which in-exhaust-manifold water vapor partial pressure P4 is equal to saturated water vapor pressure P0. For example, condensation occurrence temperature Tktr is specifically calculated for the case where atmospheric pressure Pa is equal to 760 mmHg (101.3 kPa) and the outside-air temperature is equal to 25° C. In this case, saturated water vapor pressure P0 is determined to be 24.65 mmHg (3.29 kPa) using the table of FIG. 4A as follows.

$$P0 = (17.5[\text{mmHg}] + 31.8[\text{mmHg}])/2 = 24.65[\text{mmHg}]$$

$$P0 = (2.33[\text{kPa}] + 4.24[\text{kPa}])/2 = 3.29[\text{kPa}]$$

The result is substituted into equation (11) to determine in-exhaust-manifold water vapor partial pressure P4 as follows.

$$P4 = 24.65 \times 0.8412 + 760 \times 0.1059 = 101.2[\text{mmHg}]$$

$$P4 = 3.29 \times 0.8412 + 101.3 \times 0.1059 = 13.50[\text{kPa}]$$

The temperature at which saturated water vapor pressure P0 is equal to this value 101.2 mmHg (13.50 kPa), or condensation occurrence temperature Tktr is determined to be 51.5° C. by using the table of FIG. 4A and calculating the following linear proximate expression.

$$Tktr = 50[°\text{C.}] + (101.2[\text{mmHg}] - 92.5[\text{mmHg}]) \times (60[°\text{C.}] - 50[°\text{C.}])/(149[\text{mmHg}] - 92.5[\text{mmHg}]) = 51.5[°\text{C.}]$$

$$Tktr = 50[°\text{C.}] + (13.50[\text{kPa}] - 12.3[\text{kPa}]) \times (60[°\text{C.}] - 50[°\text{C.}])/(19.9[\text{kPa}] - 12.3[\text{kPa}]) = 51.5[°\text{C.}]$$

Thus, in the engine, which has the engine specification represented by the above four conditions, under the environmental conditions that atmospheric pressure Pa is equal to 760 mmHg (101.3 kPa) and the outside-air temperature is equal to 25° C., if idling is stopped when the exhaust manifold temperature is lower than or equal to 51.5° C., condensation occurs within exhaust manifold 46 (or at air-fuel ratio sensor 51).

The following describes a method for estimating the exhaust manifold temperature.

Figure 6:
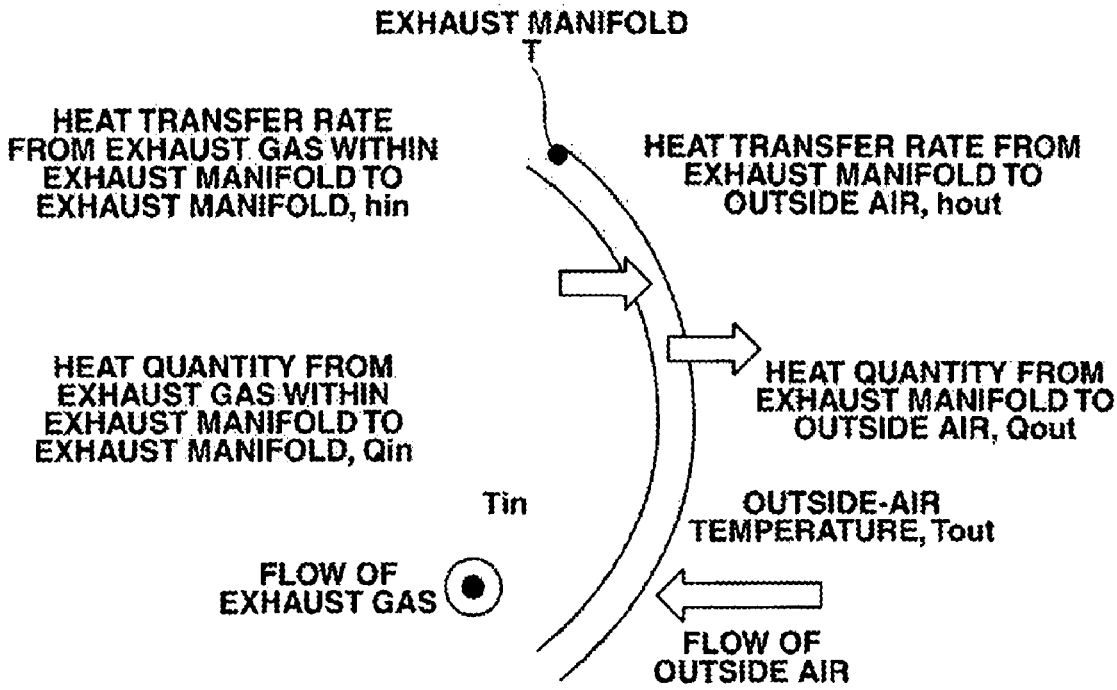
FIG. 6 is an outline diagram of a process for estimating exhaust manifold temperature.

FIG. 6 outlines a process in which engine controller 22 estimates the temperature of exhaust manifold 46. In FIG. 6, exhaust gas flows away from the reader (i.e., into the page) on the left side. The quantity of heat transferred from the exhaust gas within exhaust manifold 46 to exhaust manifold 46 is represented by Qin, and the quantity of heat transferred from exhaust manifold 46 to the outside air is represented by Qout.

First, the quantity of heat transferred from the exhaust gas within exhaust manifold 46 to exhaust manifold 46, Qin, is calculated by the following equation.

$$Q\text{in} = h\text{in} \times (T\text{in} - \text{Texmani(preceding)}) \quad (12)$$

where:

hin is a heat transfer rate;

Tin is the exhaust gas temperature; and

Texmani(preceding) is the preceding value of the exhaust manifold temperature.

Here, heat transfer rate, hin, is a heat transfer rate between exhaust manifold 46 and the exhaust gas within exhaust manifold 46, which is set, when engine 2 is rotating, to a heat transfer rate (for example, 30 kcal/$m^2$hk) for the case where the exhaust gas is flowing, and is set, when engine 2 is not rotating, to a heat transfer rate (for example, 4 kcal/$m^2$hk) for the case where the exhaust gas is stationary.

Exhaust gas temperature Tin, which is the temperature of the exhaust gas within exhaust manifold 46, is set as follows.

[1] While engine 2 is rotating and fuel injection is being carried out:

Tin is set to an exhaust gas temperature (constant value) for the case where the engine rotates at idle speed.

[2] While engine 2 is rotating and fuel is being cut off:

Tin is set equal to the intake air temperature (equal to the outside-air temperature).

[3] While engine 2 is not rotating:

Tin is set to a value, which is initially equal to the intake air temperature and increases according to the elapsed time after engine stop. This is because the exhaust gas within exhaust manifold 46 is heated by the quantity of heat transferred from exhaust manifold 46.

On the other hand, the quantity of heat transferred from exhaust manifold 46 to the outside air, Qout, is calculated by the following equation.

$$Q\text{out} = h\text{out} \times (\text{Texmani(preceding)} - T\text{out}) \quad (13)$$

where:

hout is a heat transfer rate;

Tout is the outside-air temperature; and

Texmani(preceding) is the preceding value of the exhaust manifold temperature.

Here, heat transfer rate hout is a heat transfer rate between exhaust manifold 46 and the exhaust gas within exhaust manifold 46, which is set, when the vehicle is running or the radiator fan is rotating, to a heat transfer rate (for example, 10 kcal/$m^2$hk) for the case where the air is flowing, and is set, when the vehicle is stationary and the radiator fan is stationary, to a heat transfer rate (for example, 4 kcal/$m^2$hk) for the case where the air is stationary.

Thus, the quantity of heat transferred from the exhaust gas within exhaust manifold 46 to exhaust manifold 46, Qin, and the quantity of heat transferred from exhaust manifold 46 to the outside air, Qout, are determined. The current temperature of exhaust manifold 46 is estimated based on the two values by the following equation.

$$\text{Texmani} = (Q\text{in} - Q\text{out})/(M \times C) + \text{Texmani(preceding)} \quad (14)$$

where:

Texmani is the exhaust manifold temperature;

M is a mass;

C is a specific heat; and

Texmani(preceding) is the preceding value of the exhaust manifold temperature.

Here, the mass of exhaust manifold 46, M, is equal to a value determined in accordance with engine specifications (for example, 5 kg). The specific heat of exhaust manifold 46, C, is equal to a value determined in accordance with constituent materials of exhaust manifold 46. For example, in the case where the constituent material is iron, specific heat C is equal to 0.442 kJ/kgK.

Next, the control process carried out by engine controller 22 is described with reference to the following flow chart.

Figure 7:
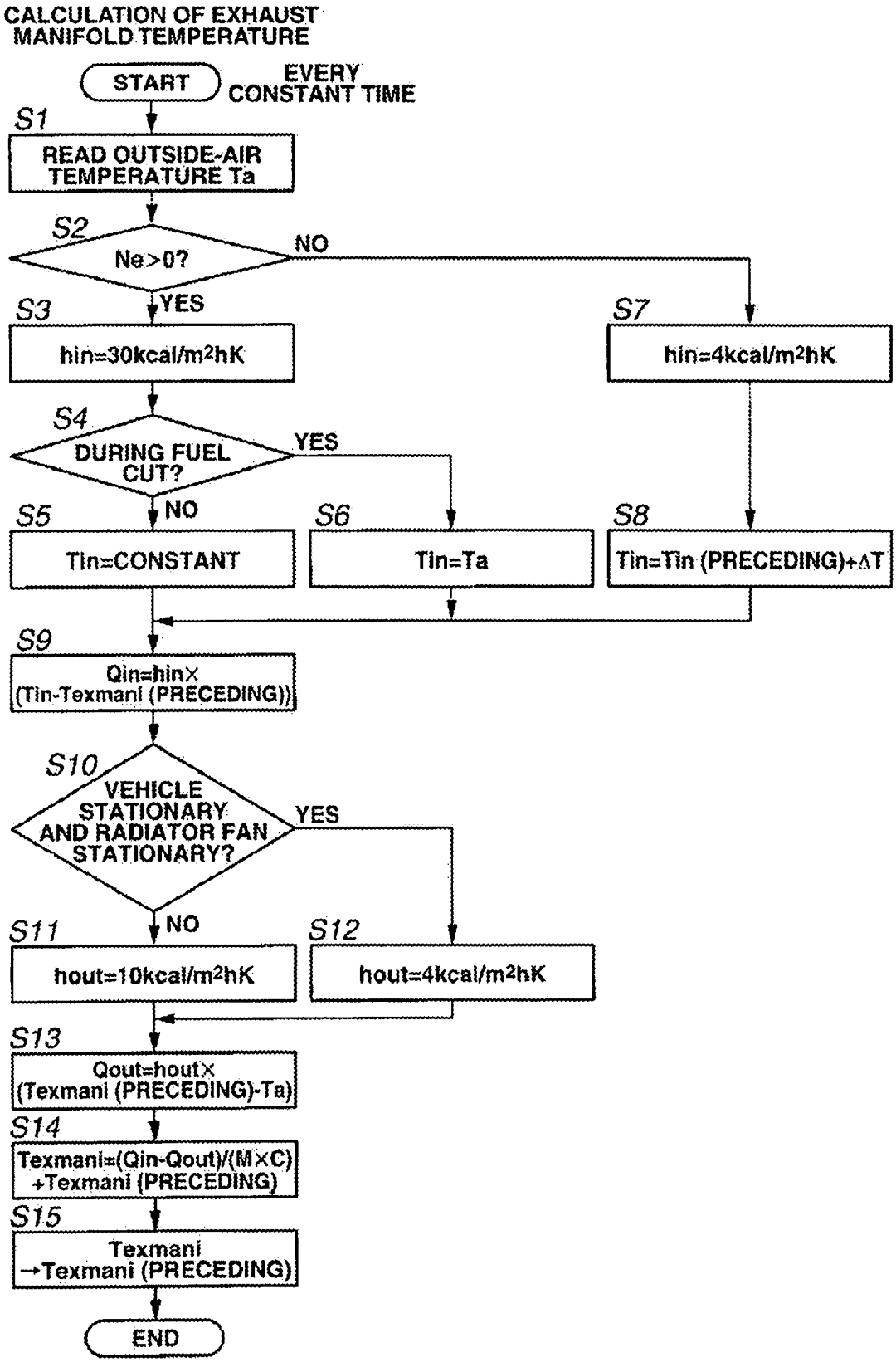
FIG. 7 is a flow chart for describing a determination of exhaust manifold temperature.

FIG. 7 shows a flow chart for calculating the exhaust manifold temperature, which is carried out at constant intervals (for example, every 10 ms).

At step S1, outside-air temperature Ta, which is sensed by temperature sensor 53, is read.

At step S2, it is checked whether or not engine 2 is rotating, by comparing the rotational speed of engine 2, Ne, with zero. When engine rotational speed Ne is not equal to zero, the control process proceeds to step S3, at which the heat transfer rate for the case where the exhaust gas is flowing (for example, 30 kcal/$m^2$hk) is substituted into heat transfer rate hin.

At step S4, it is checked whether or not the fuel is currently cut off. When fuel is not cut off, the control process proceeds to step S5, at which pint the exhaust gas temperature (constant value) for the case where the engine rotates at idle speed is substituted into exhaust gas temperature Tin. When fuel is cut off, the control process proceeds from step S4 to step S6, at which outside-air temperature Ta is directly substituted into exhaust gas temperature Tin.

On the other hand, when engine 2 is not rotating at step S2, the control process proceeds to steps S7 and S8, at which point the heat transfer rate for the case where the exhaust gas is stationary (for example, 4 kcal/$m^2$hk) is substituted into heat transfer rate, hin, and exhaust gas temperature, Tin, is calculated by the following equation.

$$Tin = Tin(\text{preceding}) + \Delta T \quad (15)$$

where:

ΔT is an increase in temperature per control cycle; and

Tin(preceding) is the preceding value of Tin.

This equation expresses that the exhaust gas within exhaust manifold 46 is heated by the quantity of heat transferred from exhaust manifold 46. The initial value of Tin (preceding) is set equal to the intake air temperature (equal to outside-air temperature Ta).

At step S9, the quantity of heat transferred from the exhaust gas within exhaust manifold 46 to exhaust manifold 46, Qin, is calculated by the above equation (12).

At step S10, it is checked whether or not the vehicle is stationary and the radiator fan is stationary, on the basis of the signals of the vehicle speed and the radiator fan switch. When the vehicle is stationary and the radiator fan is stationary, the control process proceeds to step S12, at which the heat transfer rate for the case where the exhaust gas is stationary (for example, 4 kcal/$m^2$hk) is substituted into heat transfer rate hout. When the vehicle is running or the radiator fan is rotating, the control process proceeds from step S10 to step S11, at which the heat transfer rate for the case where the air is flowing (for example, 10 kcal/$m^2$hk) is substituted into heat transfer rate hout.

At step S13, the quantity of heat transferred from exhaust manifold 46 to the outside air, Qout, is calculated by the following equation.

$$Qout = hout \times (Texmani(\text{preceding}) - Ta) \quad (16)$$

At step S14, exhaust manifold temperature Texmani is calculated based on the two heat quantities Qin and Qout thus obtained at steps S9 and S13 by using the above equation (14).

Incidentally, when exhaust manifold temperature Texmani, which is determined by equation (14), is expressed in terms of the unit Kelvin [K], unit conversion to Celsius [° C.] is carried out.

At step S15, the value of exhaust manifold temperature Texmani is substituted into exhaust manifold temperature Texmani (preceding) which represents the preceding value of the exhaust manifold temperature. After that, the current process ends.

Figure 8:
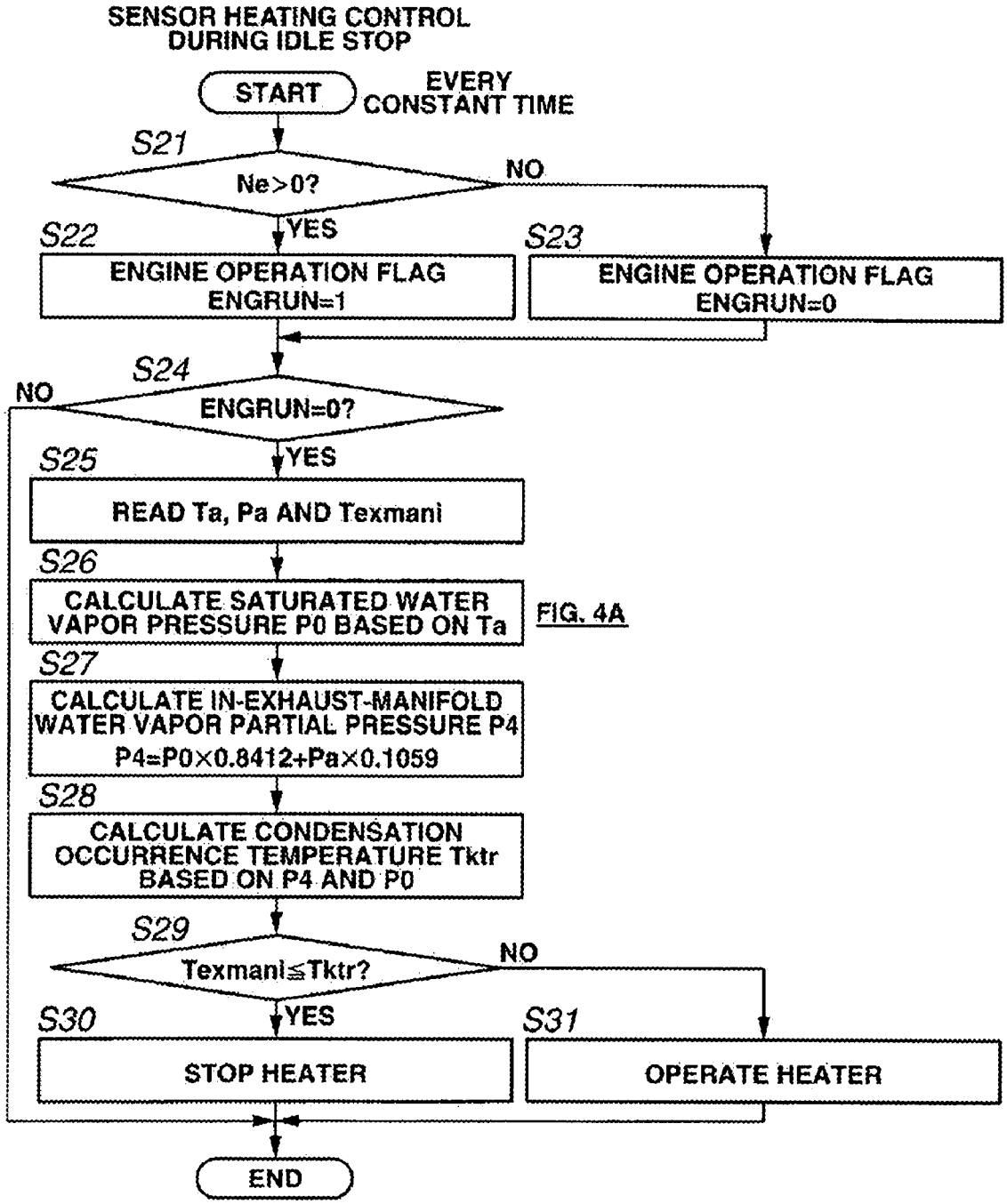
FIG. 8 is a flow chart for describing sensor heating control during idle stop.

FIG. 8 shows a flow chart for carrying out a sensor heating control process during idle stop, which is carried out at constant intervals (for example, every 10 ms) subsequent to the flow chart of FIG. 7.

At step S21, it is checked whether or not engine 2 is rotating, by comparing the rotational speed of engine 2, Ne, with zero. When engine rotational speed Ne is not equal to zero, the control process proceeds to step S22, at which an engine operation flag ENGRUN is set equal to 1. On the other hand, when engine rotational speed Ne is equal to zero, the control process proceeds to step S23, at which engine operation flag ENGRUN is set equal to 0. When ENGRUN=0, the engine operation flag indicates that it is during idle stop. When ENGRUN=1, the engine operation flag indicates that it is not during idle stop.

At step S24, engine operation flag ENGRUN is checked. When engine operation flag ENGRUN is equal to 1, the process ends immediately.

When engine operation flag ENGRUN is equal to zero (i.e. during idle stop), the control process proceeds to step S25, at which outside-air temperature Ta sensed by temperature sensor 53, atmospheric pressure Pa sensed by pressure sensor 54, and exhaust manifold temperature Texmani calculated at step S14 of FIG. 7, are read.

At step S26, saturated water vapor pressure P0 is calculated by searching the table of FIG. 4A based on outside-air temperature Ta. If the outside-air temperature is not equal to a standard outside-air temperature, such as 0° C., 10° C., 20° C. or 100° C., saturated water vapor pressure P0 is calculated by using linear interpolation equations.

In the embodiment, the saturated water vapor pressure is calculated, that is, the water vapor partial pressure of intake air for the case where the humidity of the outside air is equal to 100% is calculated, because the embodiment is targeted to the case where there no humidity sensor is provided for sensing the humidity of the outside air. However, the disclosure only exemplary and is not limited to this case. In the case of an engine provided with a sensor for sensing the temperature of outside air and a sensor for sensing the humidity of outside air: a map of intake air water vapor partial pressure P1, which is determined in accordance with the temperature and humidity of outside air may be prepared in memory within engine controller 22; intake air water vapor partial pressure P1 may be determined by searching the map on the basis of the temperature and humidity of outside air sensed by the sensors; and the saturated water vapor pressure P0 may be used instead of intake air water vapor partial pressure P1. On the other hand, when a sensor failure makes it impossible to sense the humidity of outside air, it is sufficient to determine the water vapor partial pressure of intake air for the case where the humidity of the outside air is equal to 100% is calculated, that is, determine saturated water vapor pressure P0, and to use this saturated water vapor pressure P0 instead of intake air water vapor partial pressure P1. At step S27, in-exhaust-manifold water vapor partial pressure P4 is calculated on the basis of saturated water vapor pressure P0 and atmospheric pressure Pa by the following equation, which is identical to the above equation (11).

$$P4=P0\times0.8412+Pa\times0.1059 \quad (16)$$

At step S28, the temperature at which the thus-determined in-exhaust-manifold water vapor partial pressure P4 is equal to saturated water vapor pressure P0, i.e. condensation occurrence temperature Tktr, is calculated. Condensation occurrence temperature Tktr can be determined as explained above in accordance with the section including the notation <5>.

At step S29, exhaust manifold temperature Texmani and condensation occurrence temperature Tktr are compared with each other. When exhaust manifold temperature Texmani is lower than or equal to condensation occurrence temperature Tktr, it is possible that the condensation that occurs within exhaust manifold 46 could cause potential damage such as a heat shock in air-fuel ratio sensor 51, and accordingly, the control process proceeds to step S30, at which point electric power supply to heater 52 is stopped or otherwise adjusted downwardly. This is because when condensation occurs in air-fuel ratio sensor 51, which is heated to the activation temperature, a heat shock may result, potentially resulting in the undesirable cracking of a sensor element, and because this is to be prevented.

In this embodiment, the electric power supply to heater 52 is stopped. However, in the case where it is possible to adjust the heating performance of heater 52 by adjusting the supply power to heater 52, the heating performance of heater 52 for air-fuel ratio sensor 51 may be lowered by lowering the supply power to heater 52, and air-fuel ratio sensor 51 may be heated with such a level that potential damage such as a heat shock is not caused even when condensation occurs in air-fuel ratio sensor 51.

On the other hand, when exhaust manifold temperature Texmani is above condensation occurrence temperature Tktr, it is considered that condensation does not occur to such an extent so as to potentially cause damage in air-fuel ratio sensor 51, and the control process proceeds to step S31, at which air-fuel ratio sensor 51 is heated to a target temperature by operating the heater 52 by supplying electric power to heater 52.

The following describes advantageous effects in accordance with the exemplary description above.

In a vehicle which has the functions of performing an idle stop (automatically stops engine 2) when an idle stop permission condition (a predetermined operating condition) is satisfied while the vehicle is running, and automatically restarting engine 2 when the idle stop permission condition is unsatisfied (when another predetermined operating condition is satisfied) (e.g., a hybrid vehicle) one or more exhaust gas sensors and an associated heater 52 (heating device) are provided. Of course, in some embodiments, a hybrid vehicle is not necessary. Condensation occurrence temperature Tktr is estimated as discussed above based on environmental conditions as well as known engine specifications, during idle stop (when the engine is automatically stopped) (refer to steps S24 and S28 of FIG. 8) If the exhaust manifold temperature Texmani (exhaust pipe temperature) is higher than or equal to condensation occurrence temperature Tktr during idle stop, air-fuel ratio sensor 51 is heated to its activation temperature by heater 52 (refer to steps S24, S29 and S31 of FIG. 8). However, if the exhaust manifold temperature Texmani is lower than condensation occurrence temperature Tktr during idle stop, the heating performed by heater 52 is stopped or otherwise lowered to an acceptable level (refer to steps S24, S29 and S30 of FIG. 8). For different environmental conditions or engine specifications, the controlling of heater 52 prevents a situation where even while condensation occurs within exhaust manifold 46 (exhaust pipe), unacceptable levels of electric power is supplied to heater 52, and a situation where even while condensation does not occur within exhaust manifold 46, electric power is not supplied to heater 52, during idle stop.

Condensation occurrence temperature Tktr is a temperature at which in-exhaust-manifold water vapor partial pressure P4 (the water vapor partial pressure of a gas which resides within the exhaust pipe) is equal to saturated water vapor pressure P0 during idle stop. This enables to calculate precisely condensation occurrence temperature Tktr.

If the idle stopping is implemented by cutting off the fuel supply when the engine 2 is in idle state, in-exhaust-manifold water vapor partial pressure P4 during idle stop is calculated based on exhaust gas water vapor partial pressure P3 in the idle state and based on the water vapor partial pressure of an intake air, which is exhausted to exhaust manifold 46 by rotation of the engine after the fuel supply is cut off, P1 (refer to the above equation (10)). This enables the precise determination of in-exhaust-manifold water vapor partial pressure during idle stop P4 even if the idle stopping is implemented by cutting off the fuel supply when the engine is in idle state and intake air is exhausted to exhaust manifold 46 after the fuel supply is cut off The quantity of intake air that is exhausted to exhaust manifold 46 by rotation of the engine after the fuel supply is cut off is determined in accordance with the intake pressure and the number of turns of the engine after the fuel supply is cut off According to this embodiment, the quantity of intake air which is exhausted to exhaust manifold 46 by rotation of the engine after the fuel supply is cut off, Vaex, is calculated based on intake pressure, Boost, and based on the number of turns of the engine after the fuel supply is cut off (the number of turns of the engine until the engine stops after the fuel supply is cut off) (refer to the above equations (8) and (9)). This enables the precise calculation of the quantity of intake air, which is exhausted to exhaust manifold 46 by rotation of the engine after the fuel supply is cut off, Vaex, for different intake pressures, Boost, and different numbers of turns of the engine after the fuel supply is cut off, both of which are dependent on the applicable engine specifications.

The quantity of intake air, which is exhausted to exhaust manifold 46 by rotation of the engine after the fuel supply is cut off is determined in accordance with intake valve closing timing, IVC, at idle state immediately before fuel supply is cut off, because the cylinder intake capacity varies in accordance with intake valve closing timing IVC. According to this embodiment, the quantity of intake air that is exhausted to exhaust manifold 46 by rotation of the engine after the fuel supply is cut off, Vaex, is calculated also based on intake valve closing timing IVC at idle state immediately before fuel supply is cut off (refer to the above equations (8) and (9)). This enables the precise calculation of the quantity of intake air that is exhausted to exhaust manifold 46 by rotation of the engine after the fuel supply is cut off, Vaex, for different intake valve closing timings, IVC, at idle state immediately before fuel supply is cut off.

When temperature sensor 53 (temperature sensing means) is provided, intake air water vapor partial pressure, P1 (i.e. saturated water vapor pressure P0), is calculated based on outside-air temperature, Ta, which is sensed by temperature sensor 53, on the assumption that the outside-air humidity is equal to 100%. Accordingly, the calculated condensation occurrence temperature, Tktr, is equal to a higher temperature (on the safe side) than the actual condensation occurrence temperature. Thus, the undesirable decreasing in the durability of air-fuel ratio sensor 51 is reliably prevented, even in engines provided with no humidity sensor (humidity sensing means).

When pressure sensor 54 (atmospheric pressure sensing means) is provided, in-exhaust-manifold water vapor partial pressure P4 (the water vapor partial pressure of the gas which resides within the exhaust pipe) is calculated based on atmospheric pressure, Pa, which is sensed by pressure sensor 54 (refer to the above equation (11)). This enables to calculate precisely in-exhaust-manifold water vapor partial pressure P4 for different atmospheric pressures Pa Although the embodiment is described in the case where condensation occurrence temperature, Tktr, is a temperature at which water vapor partial pressure, P4, is equal to saturated water vapor pressure, P0, in the gas which resides within the exhaust pipe when the engine is automatically stopped, another embodiment where condensation occurrence temperature, Tktr, is a temperature at which water vapor partial pressure, P3, is equal to saturated water vapor pressure, P0, in exhaust gas is possible. In this case, although the quantity of intake air (the quantity of fresh air) which is exhausted to exhaust manifold 46 by rotation of the engine after the fuel supply is cut off, Vaex, is omitted, it is possible to properly determine the condensation occurrence temperature when the quantity of intake air that is exhausted to exhaust manifold 46 by rotation of the engine after the fuel supply is cut off, Vaex, is small. Accordingly, compared to the control in which the heating performed by heater 52 is always stopped during idle, it is possible to reduce the frequency at which the heating performed by heater 52 is stopped, and thereby to improve the exhaust performance.

Although the embodiment has been described above, there is no intention to limit the scope of application of the disclosure to the construction of the embodiment. For example, the type and installed position of sensors such as sensor 52 may be modified as appropriate. Moreover, for example, although the temperature of exhaust manifold 46 is estimated, a temperature sensor may be attached to exhaust manifold 46 and the exhaust manifold temperature may be directly sensed. Further, although the case where the disclosure is applied to the hybrid vehicle is described as an example, it is intended that it can be widely applied to other vehicles such as vehicles in which a temporary halt of an engine (including idle stop) is carried out.

Step S28 of FIG. 8 implements a condensation occurrence temperature estimation processing step. Steps S29 to S31 of FIG. 8 implement a heating control processing step.

Step S28 of FIG. 8 implements the function of condensation occurrence temperature estimation means. Steps S29 to S31 of FIG. 8 implement the function of heating control means. Step S27 of FIG. 8 implements exhaust gas water vapor partial pressure calculation means.

The preceding description has been presented only to illustrate and describe exemplary embodiments of the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A vehicle control apparatus for a vehicle, which includes an engine having at least one exhaust gas sensor associated with an exhaust passage of the engine for sensing a property of an exhaust gas, and a heater for heating the exhaust gas sensor, wherein the engine is selectively controlled to stop automatically when a predetermined operation condition is satisfied, the vehicle control apparatus comprising:

an environmental condition sensing mechanism that senses, when an engine is automatically stopped, at least one environmental condition, the at least one environmental condition including at least one of an atmospheric temperature and an atmospheric pressure; and a controller, wherein the controller includes:

a condensation occurrence temperature estimation mechanism that estimates a condensation occurrence temperature based on the at least one environmental condition and based on a parameter related to a gas that is selectively exhausted to an exhaust passage until the engine stops rotation after a fuel supply of the engine is cut off; and a heating control mechanism that selectively heats an exhaust gas sensor to a desired activation temperature with a heater if a temperature of the exhaust passage is higher than or equal to the condensation occurrence temperature when the engine is automatically stopped, and selectively performs, if the exhaust passage temperature is lower than the condensation occurrence temperature when the engine is automatically stopped, one of lowering heating performance of the heater and stopping the heating performed by the heater.

2. The vehicle control apparatus according to claim 1, wherein the controller selectively determines a water vapor partial pressure in the exhaust passage, and wherein the condensation occurrence temperature is set to a temperature at which the water vapor partial pressure is equal to or substantially equal to a saturated water vapor pressure.

3. The vehicle control apparatus according to claim 1, wherein the controller further including an exhaust gas water vapor partial pressure calculation mechanism, the exhaust gas water vapor partial pressure calculation mechanism selectively calculates a water vapor partial pressure of a gas that resides within the exhaust passage when the engine is automatically stopped, and wherein the condensation occurrence temperature is set to a temperature at which the water vapor partial pressure is equal to or substantially equal to a saturated water vapor pressure.

4. The vehicle control apparatus according to claim 3, wherein the exhaust gas water vapor partial pressure calculation mechanism calculates, if the engine is stopped by cutting off the fuel supply when the engine is in an idle state, the water vapor partial pressure of the gas that resides within the exhaust passage, based on a water vapor partial pressure of exhaust gas in the idle state and based on a water vapor partial pressure of an intake air that is exhausted to the exhaust passage by rotation of the engine after the fuel supply is cut off.

5. The vehicle control apparatus according to claim 4, wherein the exhaust gas water vapor partial pressure calculation mechanism selectively calculates a quantity of the intake air that is exhausted to the exhaust passage by rotation of the engine after the fuel supply is cut off based on an intake pressure and based on the number of turns of the engine after the fuel supply is cut off.

6. The vehicle control apparatus according to claim 5, wherein the exhaust gas water vapor partial pressure calculation mechanism calculates the quantity of the intake air that is exhausted to the exhaust passage by rotation of the engine after the fuel supply is cut off based on an intake valve closing timing at the idle state immediately before the fuel supply is cut off.

7. The vehicle control apparatus according to claim 3, further comprising:

a temperature sensor for sensing an outside-air temperature; and a humidity sensing mechanism for sensing an outside-air humidity, and wherein the exhaust gas water vapor partial pressure calculation mechanism performs:

the calculation of a water vapor partial pressure of an intake air that is drawn into the engine, based on the outside-air temperature and humidity; and the calculation of the water vapor partial pressure of the gas that resides within the exhaust passage, based on the water vapor partial pressure of the intake air.

8. The vehicle control apparatus according to claim 7, wherein the humidity sensing mechanism is a physical sensor and the exhaust gas water vapor partial pressure calculation mechanism calculates, when the physical sensor has a failure, the water vapor partial pressure of intake air based on the sensed outside-air temperature on the assumption that the outside-air humidity is equal to or substantially equal to 100%.

9. The vehicle control apparatus according to claim 3, further comprising a temperature sensor for sensing an outside-air temperature, and wherein the exhaust gas water vapor partial pressure calculation mechanism calculates a water vapor partial pressure of an intake air based on the sensed outside-air temperature on the assumption that an outside-air humidity is equal to or substantially equal to 100% and calculates the water vapor partial pressure of the gas, which resides within the exhaust passage, based on the water vapor partial pressure of the intake air.

10. The vehicle control apparatus according to claim 3, further comprising an atmospheric pressure sensor for sensing the atmospheric pressure, wherein the exhaust gas water vapor partial pressure calculation mechanism calculates a water vapor partial pressure of exhaust gas based on the sensed atmospheric pressure and calculates the water vapor partial pressure of the gas which resides within the exhaust passage, based on the water vapor partial pressure of exhaust gas.

11. A vehicle control method for a vehicle, which includes an engine including an exhaust gas sensor associated with an exhaust passage of the engine for sensing a property of exhaust gas, and a heating device for heating the exhaust gas sensor, which when a predetermined operating condition is satisfied, automatically stops the engine, and which when another predetermined operating condition is satisfied, automatically restarts the engine, the vehicle control method comprising:

detecting at least one environmental condition when an engine is automatically stopped;

estimating a condensation occurrence temperature based on the at least one environmental condition and based on a parameter related to a gas that is selectively exhausted to an exhaust passage until the engine stops rotation after a fuel supply of the engine is cut off; and selectively heating the exhaust gas sensor to an activation temperature by an heating device if a temperature of an exhaust passage of the engine is higher than or equal to the condensation occurrence temperature when the engine is automatically stopped, and selectively performing, if the exhaust passage temperature is lower than the condensation occurrence temperature when the engine is automatically stopped, one of lowering heating performance of the heating device and stopping the heating performed by the heating device.

12. The vehicle control method according to claim 11, comprising determining a water vapor pressure in a gas residing within the exhaust passage when the engine is automatically stopped; and setting the condensation occurrence temperature to a temperature at which the water vapor partial pressure is equal to or substantially equal to a saturated water vapor pressure.

13. The vehicle control method according to claim 12, wherein, if the engine is automatically stopped by cutting off fuel supply when the engine is in an idle state, the water vapor partial pressure of the gas residing within the exhaust passage being determined based on a water vapor partial pressure of exhaust gas in the idle state and based on a water vapor partial pressure of an intake air which is exhausted to the exhaust passage by rotation of the engine after the fuel supply is cut off.

14. The vehicle control method according to claim 13, comprising calculating a quantity of the intake air that is exhausted to the exhaust passage by rotation of the engine after the fuel supply is cut off based on an intake pressure and based on the number of turns of the engine after the fuel supply is cut off.

15. The vehicle control method according to claim 12, comprising:

calculating a water vapor partial pressure of intake air based an outside-air temperature and an outside-air humidity; and calculating the water vapor partial pressure of the gas that resides within the exhaust passage, based on the water vapor partial pressure of intake air.

16. The vehicle control method according to claim 15, wherein, when the outside-air humidity cannot be detected, the water vapor partial pressure of intake air is calculated on the assumption that the outside-air humidity is equal to or substantially equal to 100%.

17. The vehicle control method according to claim 12, further comprising:

calculating a water vapor partial pressure of intake air based on an outside-air temperature on the assumption that an outside-air humidity is equal to or substantially equal to 100%; and calculating the water vapor partial pressure of the gas that resides within the exhaust passage, based on the water vapor partial pressure of intake air.

18. A vehicle control apparatus for a vehicle, which includes an engine having at least one exhaust gas sensor associated with an exhaust passage of the engine for sensing a property of an exhaust gas, and a heater for heating the exhaust gas sensor, the engine is selectively controlled to stop automatically when a predetermined operation condition is satisfied, the vehicle control apparatus comprising:

an environmental condition sensing section that senses at least one environmental condition when an engine is automatically stopped, the at least one environmental condition including at least one of an atmospheric temperature and an atmospheric pressure; and a condensation occurrence temperature estimation section that estimates a condensation occurrence temperature based on the at least one environmental condition and based on a parameter related to a gas that is selectively exhausted to an exhaust passage until the engine stops rotation after a fuel supply of the engine is cut off; and a heating control section that selectively heats an exhaust gas sensor with a heater when the engine is automatically stopped, in which the heater is selectively controlled to heat the exhaust gas sensor to a desired activation temperature if a temperature of the exhaust passage is higher than or equal to the condensation occurrence temperature, and the heater is selectively controlled to lower or stop a heating performance thereof if the exhaust passage temperature is lower than the condensation occurrence temperature.

19. A vehicle control apparatus for a vehicle, which includes an engine, wherein the engine is selectively controlled to stop automatically when a predetermined condition is satisfied, having at least one exhaust gas sensor associated with an exhaust passage of the engine for sensing a property of an exhaust gas, and a heating device for heating the exhaust gas sensor, the vehicle control apparatus comprising:

an environmental condition sensing means for sensing, when the engine is automatically stopped, at least one environmental condition, the at least one environmental condition including at least one of the atmospheric temperature and the atmospheric pressure; and a controller means, wherein the controller means includes:

a condensation occurrence temperature estimation means for estimating a condensation occurrence temperature based both on a parameter related to a gas that is selectively exhausted to the exhaust passage and also based on the at least one environmental condition; and a heating control means for selectively heating the exhaust gas sensor to a desired activation temperature using the heating device if a temperature of the exhaust passage is higher than or equal to the condensation occurrence temperature, and selectively performs, if the exhaust passage temperature is lower than the condensation occurrence temperature when the engine is automatically stopped, one of lowering heating performance of the heating device and stopping the heating performed by the heating device.

* * * * *